US008656812B2

(12) United States Patent
Kawai et al.

(10) Patent No.: US 8,656,812 B2
(45) Date of Patent: Feb. 25, 2014

(54) PLIER

(75) Inventors: Shinnosuke Kawai, Osaka (JP); Mitsuhiro Takasaki, Osaka (JP)

(73) Assignee: Engineer Inc., Osaka (JP)

( * ) Notice: Subject to any disclaimer, the term of this patent is extended or adjusted under 35 U.S.C. 154(b) by 202 days.

(21) Appl. No.: 13/321,604

(22) PCT Filed: Mar. 29, 2010

(86) PCT No.: PCT/JP2010/002251

§ 371 (c)(1), (2), (4) Date: Feb. 9, 2012

(87) PCT Pub. No.: WO2010/137223

PCT Pub. Date: Dec. 2, 2010

(65) Prior Publication Data

US 2013/0160615 A1 Jun. 27, 2013

(30) Foreign Application Priority Data

May 25, 2009 (JP) ..... 2009-125214

(51) Int. Cl.
*B25B 7/02* (2006.01)

(52) U.S. Cl.
USPC ..... 81/424.5; 81/418

(58) Field of Classification Search
USPC ..... 81/424.5, 426.5, 418, 419
See application file for complete search history.

(56) References Cited

U.S. PATENT DOCUMENTS 2,679,775 A * 6/1954 Fleming ..... 81/420
2,847,889 A * 8/1958 Cain ..... 81/424.5
3,879,981 A * 4/1975 Richards ..... 72/409.01
5,810,881 A * 9/1998 Hoskin et al. ..... 606/207
6,923,097 B2 * 8/2005 Takasaki ..... 81/418
2002/0184977 A1 * 12/2002 Eidson ..... 81/426.5

FOREIGN PATENT DOCUMENTS

JP 59-93872 6/1984
JP 4-73465 6/1992
JP 2003-291072 A 10/2003
JP 2005-279801 A 10/2005

* cited by examiner

*Primary Examiner* — David B Thomas
(74) *Attorney, Agent, or Firm* — Knobbe Martens Olson & Bear LLP

(57) ABSTRACT

The invention provides a pair of pliers capable of properly pinching a screw head and reliably removing a screw from an object to which the screw has been fastened even if the screw has small thickness of a peripheral face to be pinched between pinching teeth.

The pair of pliers is formed by coupling a first arm 1 and a second arm 2 each having a jaw portion 4 and a grip 5 through a coupling shaft 3 in an X shape. Each of the jaw portions 4, 4 is provided on left and right sides of a front end thereof with flanks 16, 16 for preventing opposite corners of front ends of each of the jaw portions 4, 4 from coming in contact with a screw fastened face 22. Each of the jaw portions 4, 4 also comprises longitudinal pinching teeth 13, 13 capable of pinching the peripheral face of the screw head 21 so as to be recessed in opposed faces of the respective jaw portions 4, 4 between the left and right flanks 16, 16. Each of the longitudinal pinching teeth 13, 13 is formed by connecting, in shapes of peaks and troughs, a plurality of streak teeth **13*a* in a front-back direction. Due to the flanks 16, 16, front ends 17 of the streak teeth 13*a* initially collide with the screw fastened face 22, so that the longitudinal pinching teeth 13 can reliably pinch the peripheral face of the screw head 21**.

9 Claims, 12 Drawing Sheets

Fig.3A
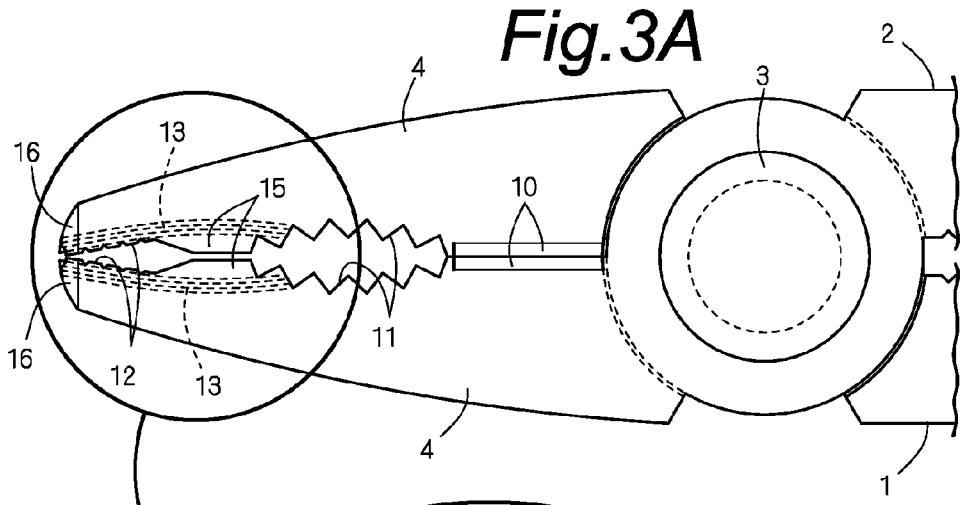
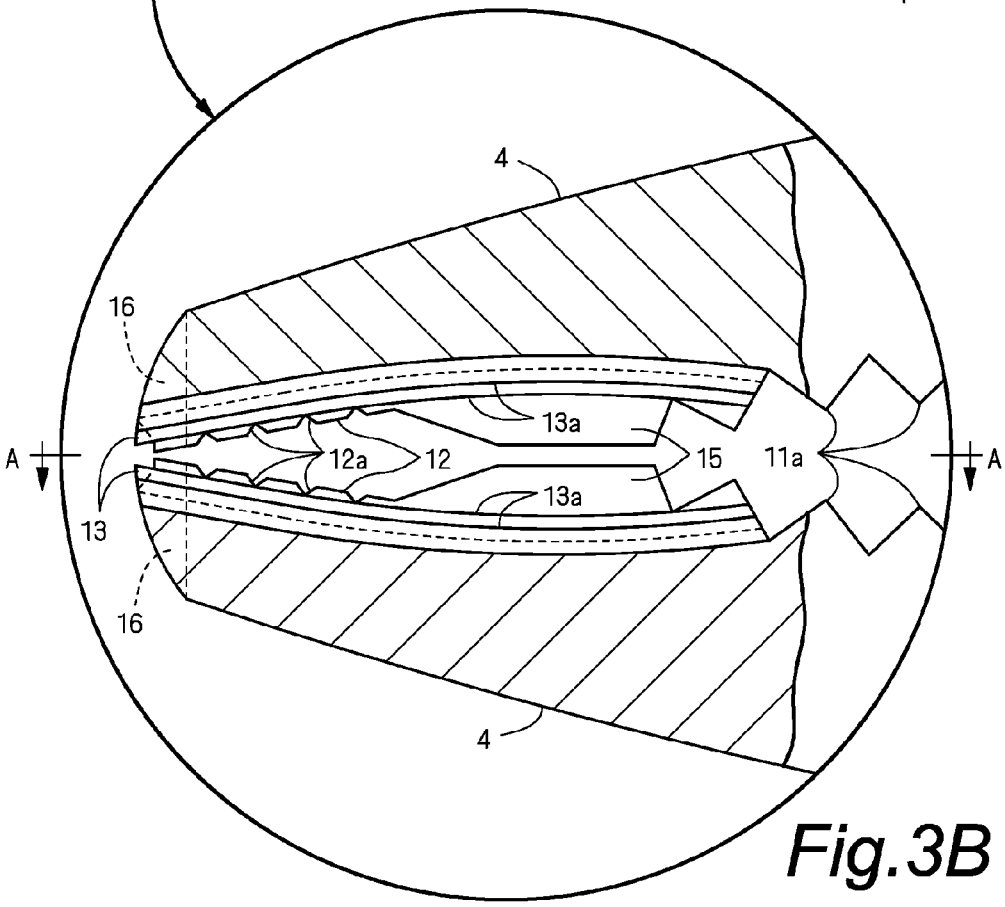
Fig.3B 11
12
12a
15
16
17
13
17
13a
16
12a
12
15
11a

Fig.6A
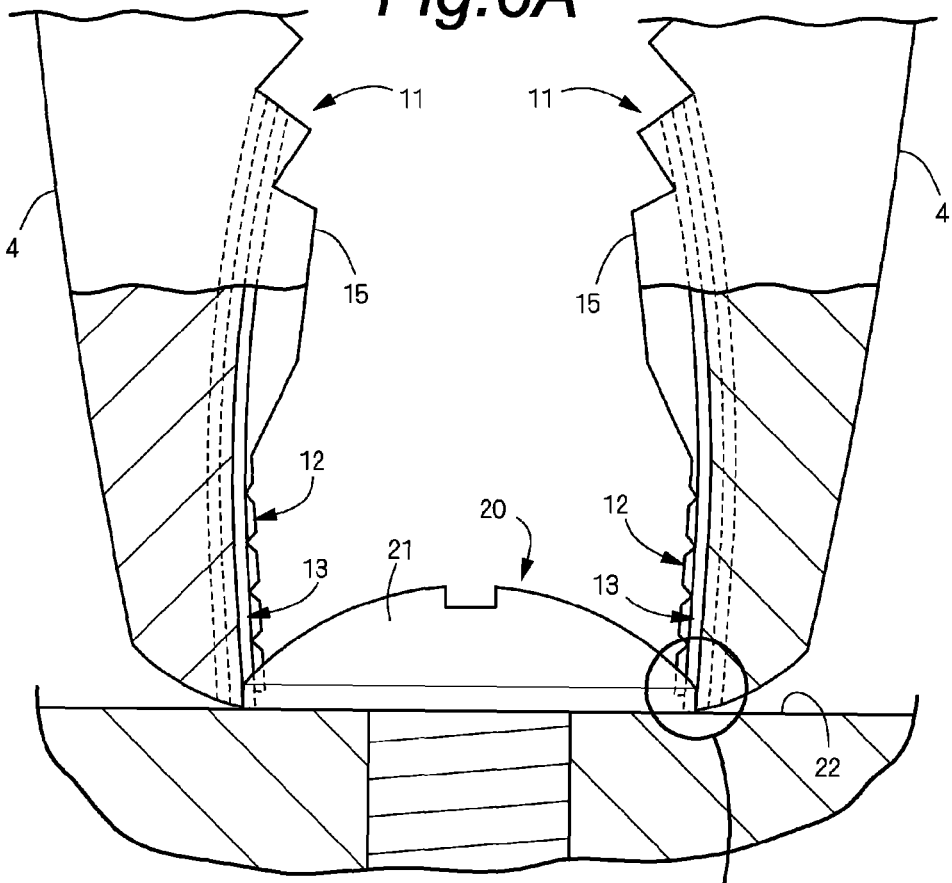
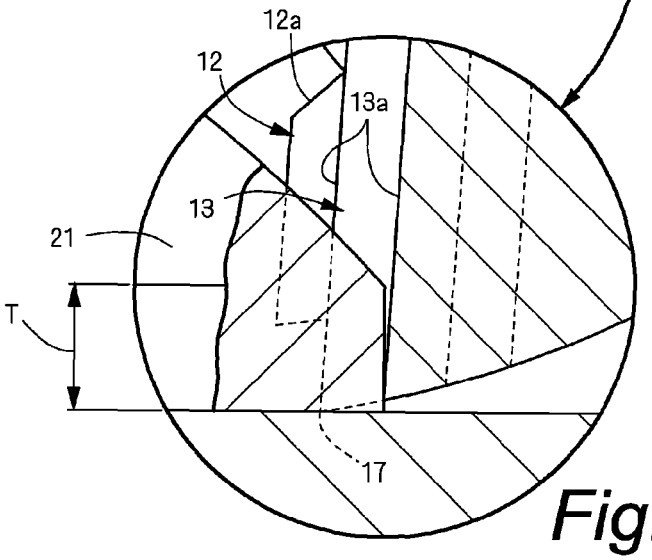
Fig.6B

Fig.11A
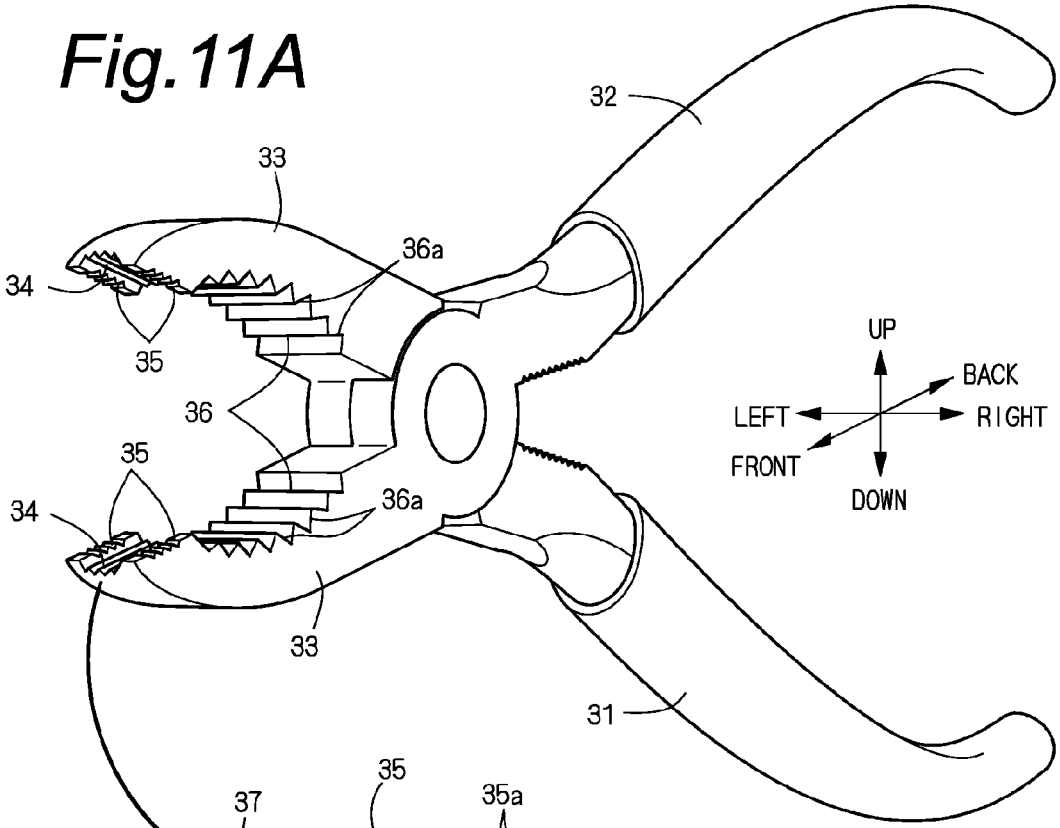
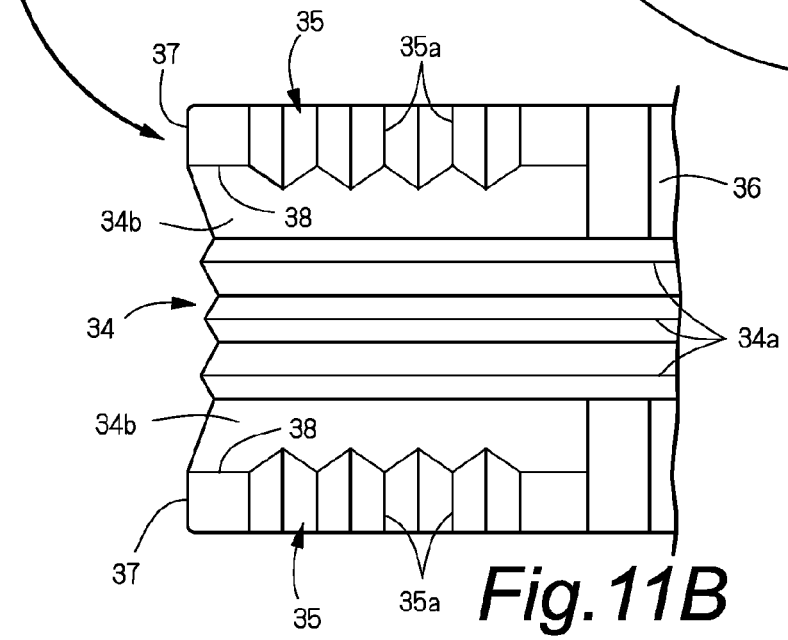
Fig.11B

PLIER

CROSS REFERENCE TO RELATED APPLICATIONS

This application claims the benefit and priority to and is a U.S. National Phase Application of PCT International Application Number PCT/JP2010/002251, filed on Mar. 29, 2010, designating the United States of America, which is an International Application of and claims the benefit of priority to Japanese Patent Application No. 2009-125214, filed on May 25, 2009. The disclosures of the above-referenced applications are hereby expressly incorporated by reference in their entireties.

TECHNICAL FIELD

The present invention relates to a pair of pliers suitable for removing a small screw (hereafter merely referred to as a screw) with a rusty screw shaft or a deformed and stripped driving groove formed in a screw head from an object to which the screw has been fastened.

BACKGROUND ART

As this type of pliers, there is a known pair of pliers proposed by the present applicant (Patent Document 1). In this pair of pliers, as shown in FIG. 11, respective opposed faces of jaw portions 33 of a pair of pinching arms 31 and 32 crossed in a shape of X are provided with longitudinal pinching teeth 34, front pinching teeth 35, and back pinching teeth 36. The longitudinal pinching teeth 34 pinch a peripheral face of a screw head 41 along a screw shaft. For example, as shown in FIG. 12, if a screw fastened face 42 is horizontal, the longitudinal pinching teeth 34 are used to pinch the peripheral face of the screw head 41 in a state in which the whole pliers are oriented vertically. The front pinching teeth 35 and the back pinching teeth 36 are used to pinch the screw head 41 or the like in a state in which the whole pliers are oriented horizontally, if the screw fastened face 42 is horizontal.

The longitudinal pinching teeth 34 are made up of three sawtooth-shaped streak teeth 34*a* and diagonal oblique sides 34*b* connected to the streak teeth 34*a* in a shape of a mountain range. The front pinching teeth 35 are disposed on opposite sides of the oblique sides 34*b* and the opposed front pinching teeth 35 mate with each other to thereby define a limit of closing of the pinching arms 31 and 32. The front pinching teeth 35 and the back pinching teeth 36 are respectively provided with streak teeth 35*a* and 36*a* orthogonal to the streak teeth 34*a* described above.

A similar pair of pliers is disclosed in Patent Document 2 in which a pair of pinching arms has a reverse crossing structure similar to a crossing form of a pair of scissors for a left-handed person to thereby suppress backlash of the pinching arms in loosening a screw.

PRIOR ART DOCUMENTS

Patent Documents

Patent Document 1: Japanese Patent No. 3486776 (Paragraphs 0009 to 0010, FIG. 4)

Patent Document 2: Japanese Patent Application Laid-Open No. 2005-279801 (Paragraphs 0015 to 0018, FIG. 1)

SUMMARY OF THE INVENTION

Problems to be Solved by the Invention

It is possible that the pair of longitudinal pinching teeth 34 of the above-described pair of pliers pinch the peripheral face of the screw head 41 as shown in the FIG. 12, thereby properly remove the screw 40 from the object to which the screw has been fastened, even if the screw 40 has a stripped driving groove and is difficult to loosen with a screwdriver. Therefore, the pliers have become popular among many users. However, they are not without problems.

To remove the screw 40 from the object to which the screw has been fastened, the pair of longitudinal pinching teeth 34 pinch the peripheral face of the screw head 41 as shown in FIG. 12, but the longitudinal pinching teeth 34 may not properly pinch the peripheral face of the screw head therebetween in some cases. For example, in a case of a screw 40 represented by a small round screw and a truss screw having small thickness T of the peripheral face to be pinched between the longitudinal pinching teeth 34, it is difficult to pinch the peripheral face of the screw head 41 with the streak teeth 34*a* and the longitudinal pinching teeth 34 are likely to come off the peripheral face of the screw head 41. The present inventor has tried to find out a cause of coming off of the longitudinal pinching teeth 34 from the peripheral face of the screw head 41 in the above-described manner and to reconsider how the jaw portions of the pliers should be structured and has obtained the following knowledge.

In the prior-art pair of pliers, the longitudinal pinching teeth 34 are formed to be recessed in shapes of peaks and troughs between the pair of left and right front pinching teeth 35 as shown in FIGS. 11 and 12. Therefore, when the pair of longitudinal pinching teeth 34 pinch the peripheral face of the screw head 41 as shown in FIG. 12, front end faces 37 of the front pinching teeth 35 initially collide with the screw fastened face 42 and front ends of the three streak teeth 34*a* forming each of the longitudinal pinching teeth 34 are kept away from the screw fastened face 42.

When the front ends of the streak teeth 34*a* are kept away from the screw fastened face 42 in the above manner, decrease in a depth of pinching between the longitudinal pinching teeth 34 is unavoidable even in a case of a screw such as a small pan head screw and a small flat head screw having large thickness T and relatively easy to pinch, if the screw has a small nominal dimension. Moreover, in a case of a screw such as a truss screw and a small round screw having small thickness T as shown in FIG. 12, the longitudinal pinching teeth 34 cannot properly cause the streak teeth 34*a* to bite into the peripheral face of the screw head 41. Although front end portions 38 of inner edges of the front pinching teeth 35 can pinch the peripheral face of the screw head 41 in this case, they have smaller biting effect than the streak teeth 34*a* and therefore it is difficult to firmly pinch the screw head 41 and the longitudinal pinching teeth 34 are likely to come off the peripheral face of the screw head 41.

The present invention has been proposed based on the above knowledge and it is an object thereof to provide a usable pair of pliers capable of properly pinching a screw head and reliably removing a screw from an object to which the screw has been fastened irrespective of an outside shape of the screw head. Especially, it is an object of the invention to provide a pair of pliers capable of reliably removing a screw, even if thickness of its peripheral face to be pinched between pinching teeth is small.

Means for Solving the Problems

A pair of pliers according to the present invention is formed by coupling a first arm 1 and a second arm 2 each having a jaw portion 4 at a front end and a grip 5 on a back end side through a coupling shaft 3 in an X shape. Each of the jaw portions 4, 4 is provided on left and right sides of the front end thereof with flanks 16, 16 for preventing opposite corners of front ends of each of the jaw portions 4, 4 from coming in contact with a screw fastened face 22 as shown in FIG. 1. Longitudinal pinching teeth 13, 13 capable of pinching a peripheral face of a screw head 21 while being orthogonal to the screw fastened face 22 are formed to be recessed in opposed faces of the respective jaw portions 4, 4 between the left and right flanks 16, 16. Each of the longitudinal pinching teeth 13, 13 is formed by connecting, in shapes of peaks and troughs in a left-right direction, a plurality of streak teeth 13*a* extending in a front-back direction. The longitudinal pinching teeth 13 for pinching the peripheral face of the screw head 21 are formed to be recessed in the opposed faces including the front ends of the respective jaw portions 4. The longitudinal pinching teeth 13 are formed by connecting, in the shapes of the peaks and the troughs in the left-right direction, the plurality of streak teeth 13*a* extending in the front-back direction. Front ends of the flanks 16, 16 are located behind front ends 17 of the streak teeth 13*a*.

In the above-described structure in which "the longitudinal pinching teeth 13, 13 capable of pinching the peripheral face of the screw head 21 are formed to be recessed in the opposed faces of the respective jaw portions 4, 4 between the left and right flanks 16, 16", "between the left and right flanks 16, 16" includes the following cases: the case in which the front portions of the flanks 16, 16 are in a left-right area where the longitudinal pinching teeth 13, 13 are formed as shown in FIG. 1; the case in which the longitudinal pinching teeth 13, 13 are formed only between the left and right front ends of the flanks 16, 16; and the case in which the longitudinal pinching teeth 13, 13 are formed between left and right positions near back ends of the flanks 16, 16.

In the pair of pliers in which the longitudinal pinching tooth 13 and front pinching teeth 12, 12 disposed on left and right sides of the longitudinal pinching tooth 13 are formed on each of opposed faces on front end sides of the respective jaw portions 4, 4, the flanks 16, 16 of the respective jaw portions 4, 4 are provided to front portions of the opposite front pinching teeth 12, 12.

As shown in FIG. 1, the flanks 16, 16 are made up of slopes inclined in shapes tapered toward the front ends of the jaw portions 4.

As shown in FIG. 9, the flanks 16, 16 are made up of vertical flat faces formed at front ends of the left and right pairs of front pinching teeth 12, 12 and front ends of the flanks 16, 16 are located behind the front ends 17 of the streak teeth 13*a*.

As shown in FIG. 10, the flanks 16, 16 are made up of recessed notch faces formed in front ends of opposed faces of the pairs of left and right front pinching teeth 12, 12 and front ends of the flanks 16, 16 are located behind the front ends 17 of the streak teeth 13*a*.

Side shapes of the streak teeth 13*a* on the upper jaw portion 4 are curved shapes recessed upward and side shapes of the streak teeth 13*a* on the lower jaw portion 4 are curved shapes recessed downward (see FIG. 3).

Effects of the Invention

In the invention, the flanks 16, 16 are formed on the left and right sides of the front ends of the jaw portions 4, 4 and the longitudinal pinching teeth 13, 13 for pinching the peripheral face of the screw head 21 are formed to be recessed in the opposed faces of the respective jaw portions 4, 4 between the left and right flanks 16, 16. If the flanks 16, 16 are formed on the left and right sides of the front ends of the jaw portions 4, 4 in this manner, the pair of longitudinal pinching teeth 13, 13 can reliably pinch the peripheral face of the screw head 21 in a state in which the front ends 17 of the streak teeth 13*a* of the longitudinal pinching teeth 13 are in contact with the screw fastened face 22. Furthermore, it is possible to increase a depth of pinching of the peripheral face of the screw head 41 between the longitudinal pinching teeth 13, 13 as compared with the prior-art pair of pliers. Therefore, the pliers of the invention can properly press the streak teeth 13*a* against or cause them to bite into the peripheral face of the screw head 21 to pinch the screw head 21, even in the case of the screw 20 having small thickness T of the peripheral face of the screw head 21, not to mention the screw 20 having large thickness T. As a result, the longitudinal pinching teeth 13, 13/the pliers of the invention (??) can properly pinch the screw head 21 to turn the screw 20 in a loosening direction and reliably remove the screw from an object to which the screw 20 has been fastened, even if the screw 20 has a rusty screw shaft or a deformed and stripped driving groove.

In the pair of pliers having the front pinching teeth 12, 12 provided on the left and right sides of the longitudinal pinching teeth 13, 13, if the flanks 16, 16 are provided at the front portions of the front pinching teeth 12, most parts of the flanks 16, 16 can be formed at the front pinching teeth 12, which makes it possible to prevent the flanks 16 from narrowing the area in which the longitudinal pinching teeth 13, 13 are formed. Therefore, the pair of longitudinal pinching teeth 13, 13 can properly pinch the opposed peripheral face of the screw head 21 so as to reliably remove the screw from the object to which the screw has been fastened, even if the screw 20 has the rusty screw shaft or the deformed and stripped driving groove. The form where the front pinching teeth 12, 12 are provided on the left and right sides of the longitudinal pinching teeth 13, 13, can increase strength of the structures of the front ends of the jaw portions including the longitudinal pinching teeth 13, 13, thereby properly carry out screw removing operation with the longitudinal pinching teeth 13, 13. Because the pinching function of the front pinching teeth 12, 12 is added, the pliers can be used for various purposes.

If the flanks 16, 16 are made up of the slopes inclined in the shapes tapered toward the front ends of the jaw portions 4 as shown in FIG. 1, they can prevent themselves from coming in contact with the screw fastened face 22, even if the jaw portions 4 are slightly inclined with respect to the screw fastened face 22 in pinching the peripheral face of the screw head 21. Therefore, the longitudinal pinching teeth 13, 13 can firmly hold the peripheral face of the screw head 21 so as to remove the screw, even if the screw 20 to be removed is in a narrow space or it is impossible to make the pair of pliers perpendicular to the screw fastened face 22 due to interference with a peripheral structure. Because the flanks 16, 16 are exposed on the opposite side faces of the jaw portions 4 when the first and second arms 1 and 2 are mounted on each other through the coupling shaft 3, working of the flanks 16, 16 is easier and it is possible to save trouble and cost required for working of the flanks 16, 16.

If the flanks 16, 16 are made up of the vertical flat faces formed at the front ends of front pinching teeth 12, 12 and the front ends of the flanks 16, 16 are located behind the front ends 17 of the streak teeth 13*a* as shown in FIG. 9, working of the flanks 16, 16 is easier and it is possible to save trouble and cost required for working of the flanks 16, 16 similarly to the above-described pair of pliers in which the flanks 16, 16 are made up of the slopes. Moreover, because the flanks 16, 16 are made up of the vertical flat faces, it is possible to prevent the flanks 16, 16 from narrowing the area in which the front pinching teeth 12, 12 are formed.

If the flanks 16, 16 are made up of recessed notch faces formed in opposed faces of the front pinching teeth 12, 12 as shown in FIG. 10, it is possible to accurately form the notch faces (flanks 16) with the front pinching teeth 12, 12 and the longitudinal pinching teeth 13, 13 in a cutting step before quenching and therefore it is possible to form the flanks 16, 16 with less trouble and cost.

If the side shapes of the streak teeth 13*a*, 13*a* on the upper and lower jaw portions 4, 4 are the curved shapes recessed upward or downward, it is possible to delay flaring of the upper and lower longitudinal pinching teeth 13, 13 wider than the parallel attitudes in opening the jaw portions 4, 4 according to different sizes of the screws. Therefore, the streak teeth 13*a*, 13*a* can reliably press against or bite into the peripheral face of the screw head 21, even in pinching the screw 20 of a large nominal dimension, not to mention the screw 20 of a small nominal dimension. In other words, the longitudinal pinching teeth 13, 13 can properly pinch screws 20 of different nominal dimensions in a wide range of sizes to remove them from the object to which the screws have been fastened.

BRIEF DESCRIPTION OF THE DRAWINGS

FIG. 3 is a side view showing details of structures of jaw portions.

FIG. 6 is a partially cut-away explanatory view of a state of use of the pair of pliers according to the invention.

FIGS. 11(*a*) and 11(*b*) shows a perspective view and a plan view showing a prior-art pair of pliers.

MODES FOR CARRYING OUT THE INVENTION

Embodiment

Figure 1:
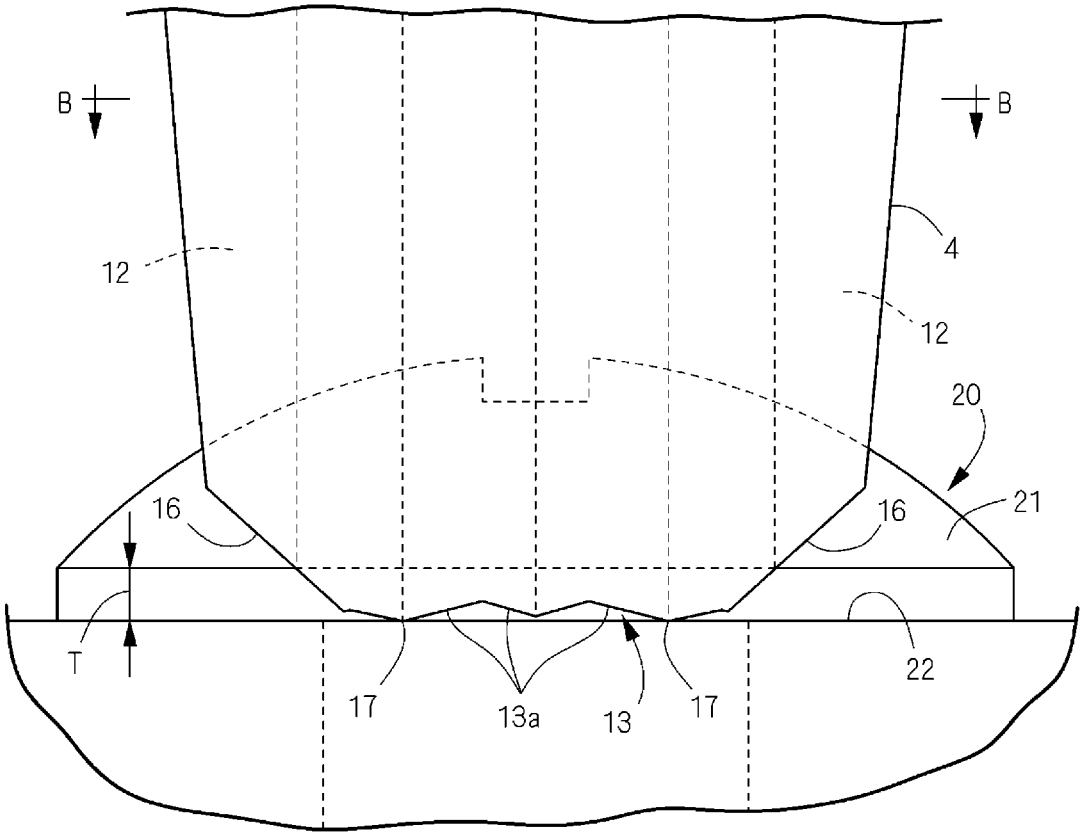
FIG. 1 is an explanatory view of a state of use of a pair of pliers according to the present invention.
Figure 2:
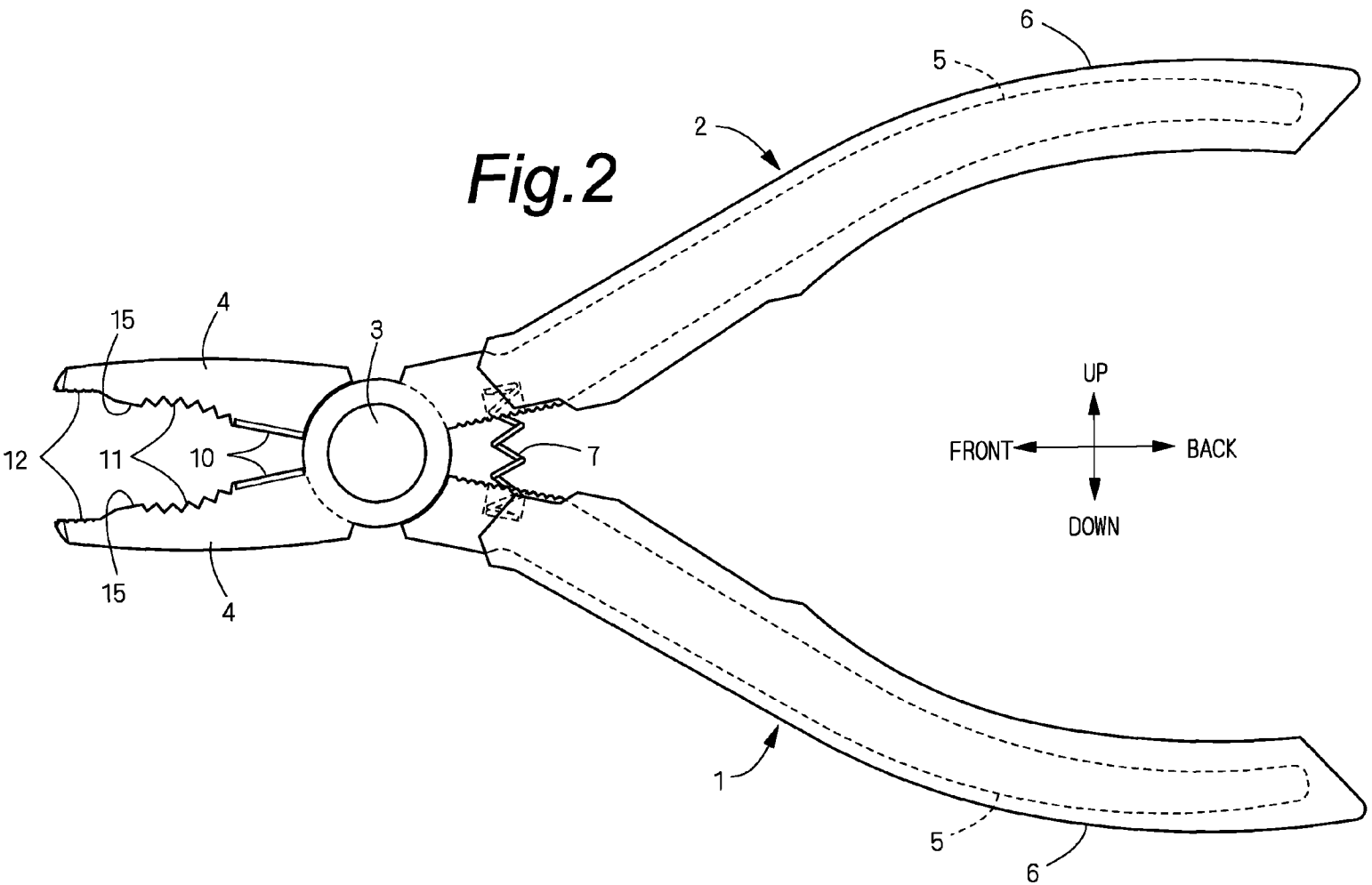
FIG. 2 is a side view of the pair of pliers according to the invention.

FIGS. 1 to 8 show an embodiment of a pair of pliers according to the present invention. In FIG. 2, the pair of pliers is formed by coupling a first arm 1 and a second arm 2 disposed in a shape of X through a coupling shaft 3 so that they can swing with respect to each other. Both the pinching arms 1 and 2 are biased in an opening direction by an opening spring 7 in a shape of a compression coil. Note that in the invention, front, back, left, right, up, and down are as indicated by intersecting arrows and words as front, back, left, right, up, and down in FIGS. 2 and 4.

Each of the arms 1 and 2 is a forging having a jaw portion 4 at its front end and a grip 5 at its back end, and an outer face of the grip 5 is covered with a grip body 6 that is a plastic molded article. The opening spring 7 described above is disposed in a vicinity of a crossing portion on the grip 5 side. On each of opposed faces of the respective jaw portions 4, cutting blades 10, back pinching teeth 11, front pinching teeth 12, and longitudinal pinching teeth 13 are formed from the intersecting portion side to the front end side of the jaw portion 4. As shown in an enlarged view of FIG. 3, front end faces of the jaw portions 4 are rounded into shapes of partial arcs in a side view.

As shown in FIG. 3, the back pinching teeth 11 are a group of sawtooth rib-shaped streak teeth 11*a* extending in a left-right direction and arranged parallel in a front-back direction mainly for pinching an object having a large pinching width. An imaginary line connecting tip ends of the streak teeth 11*a* is a curved shape recessed upward on the upper jaw portion 4 and is a curved shape recessed downward on the lower jaw portion 4.

The front pinching teeth 12 are formed on left and right opposite sides of each of the opposed faces on the front end sides of the jaw portions 4 and shallow V-shaped grooves 12*a* are formed at regular intervals in a pinching face of each of the front pinching teeth 12. The upper and lower front pinching teeth 12, 12 in a state in which both the arms 1 and 2 are gripped and the jaw portions 4 are closed are formed to be tapered toward the front ends of the jaw portions 4 and are mainly provided for pinching an object such as a plate chip and a shaft-shaped protrusion having a relatively small pinching width. The back pinching teeth 11 and the front pinching teeth 12 are separated on the front side and the back side by separating protrusions 15 that are long in the front-back direction. If the separating protrusions 15 separate both the first and second pinching teeth 11 and 12 in this manner, the separating protrusions 15 can receive the object to be pinched and prevent the object held by the respective pinching teeth 11 and 12 from moving forward or backward.

Figure 4:
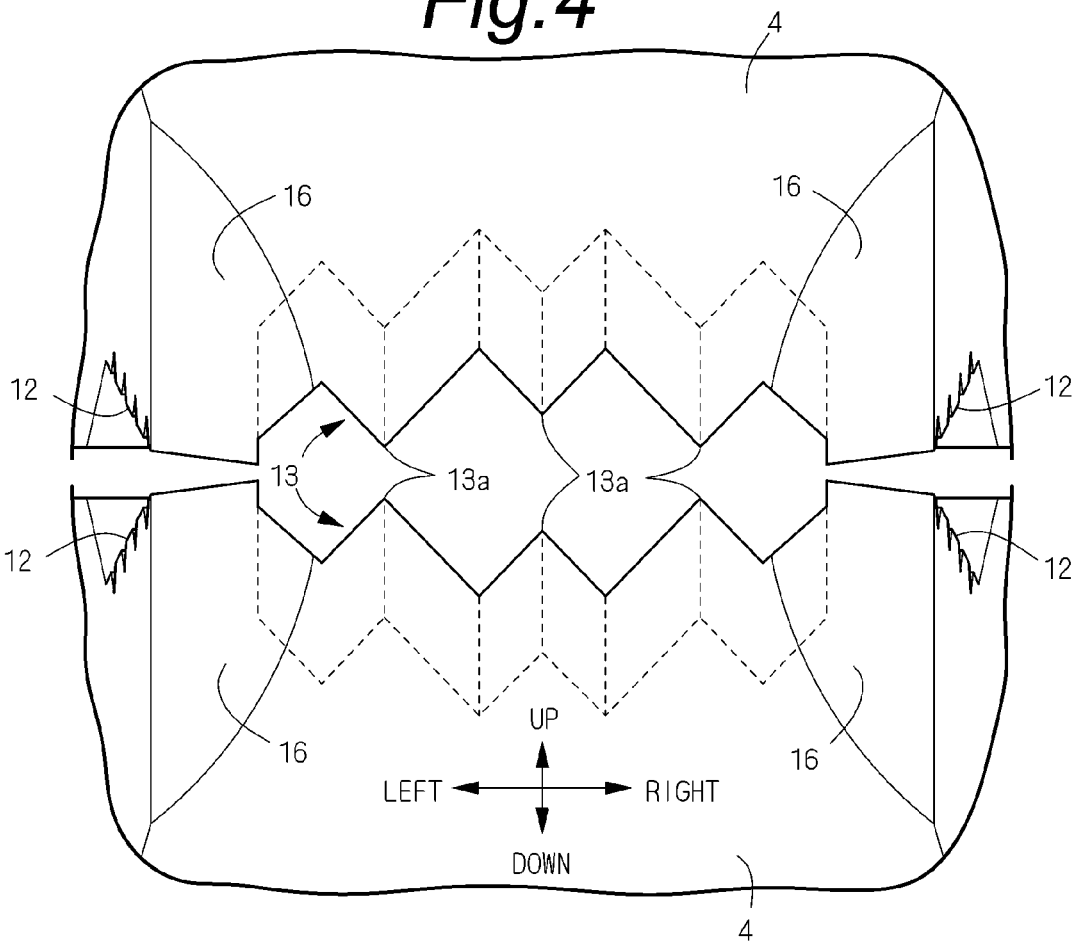
FIG. 4 is a front view showing details of the structures of the jaw portions.
Figure 5:
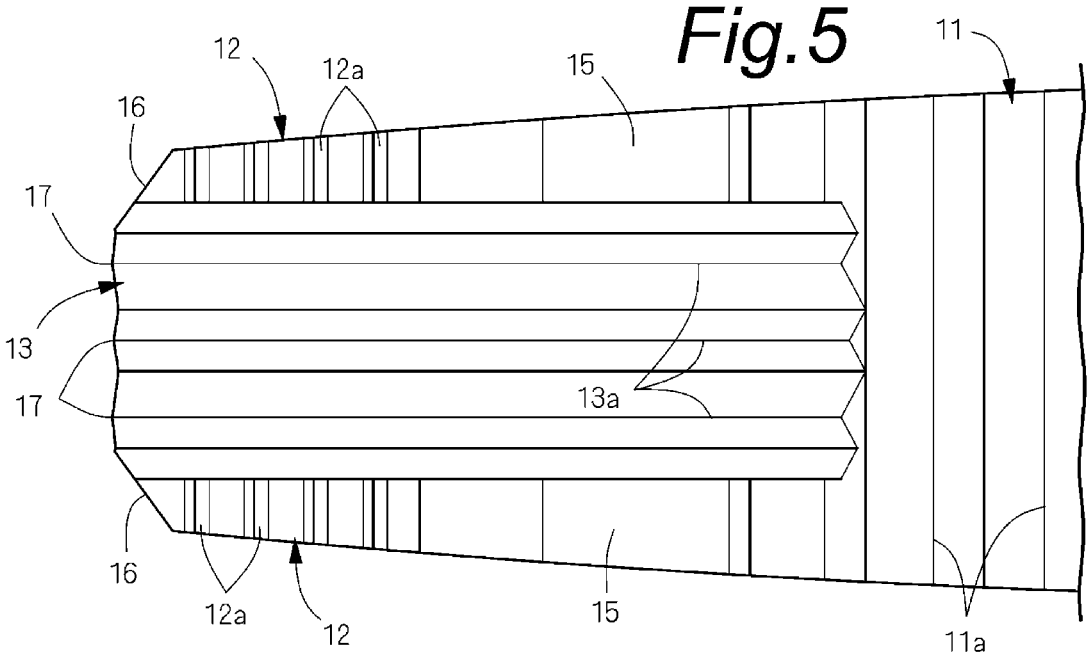
FIG. 5 is a sectional view taken along line A-A in FIG. 3.

Each of the longitudinal pinching teeth 13 is formed by connecting, in shapes of peaks and troughs in the left-right direction, three sawtooth rib-shaped streak teeth 13*a* extending in the front-back direction on each of the opposed faces including the front ends of the jaw portions 4 (see FIG. 4) and is mainly provided for pinching a peripheral face of a screw head 21 while being orthogonal to a screw fastened face 22. As shown in FIGS. 3 and 5, the longitudinal pinching teeth 13 are formed from the front ends of the jaw portions 4 to the streak teeth 11*a* positioned at the front ends of the back pinching teeth 11. In a side view of the closed jaw portions 4, the streak teeth 13*a* are formed in curved shapes recessed upward on the upper jaw portion 4 and are formed in curved shapes recessed downward on the lower jaw portion 4 (see FIG. 3). Similarly, if the jaw portions 4 are viewed from the front end side, an imaginary line connecting protruding ends of the three streak teeth 13*a* is formed in a curved shape recessed upward on the upper jaw portion 4 and is formed in a curved shape recessed downward on the lower jaw portion 4 (see FIG. 4). Each of the longitudinal pinching teeth 13 is formed at a center in the left-right direction of each of the opposed faces of the jaw portions 4 and the above-described front pinching teeth 12, 12 are provided on the left and right opposite sides of the longitudinal pinching tooth 13.

In the pair of pliers having the above-described structure, the invention is characterized in that flanks 16, 16 for preventing opposite corners of the front ends of the respective jaw portions 4, 4 from coming in contact with the screw fastened face 22 are formed on left and right opposite sides of the front end faces of the jaw portions 4, 4 as shown in FIG. 1, so that the longitudinal pinching teeth 13 can properly pinch the screw head 21. Specifically, the left and right front pinching teeth 12, 12 are respectively provided at the front portions thereof with slopes inclined in tapered shapes toward the front ends of the jaw portions 4, and the slopes are formed as flanks 16, 16. As shown in FIG. 4, the front ends of the flanks 16, 16 reach skirts of the streak teeth 13*a* at the left and right opposite ends of the longitudinal pinching teeth 13.

Figure 7:
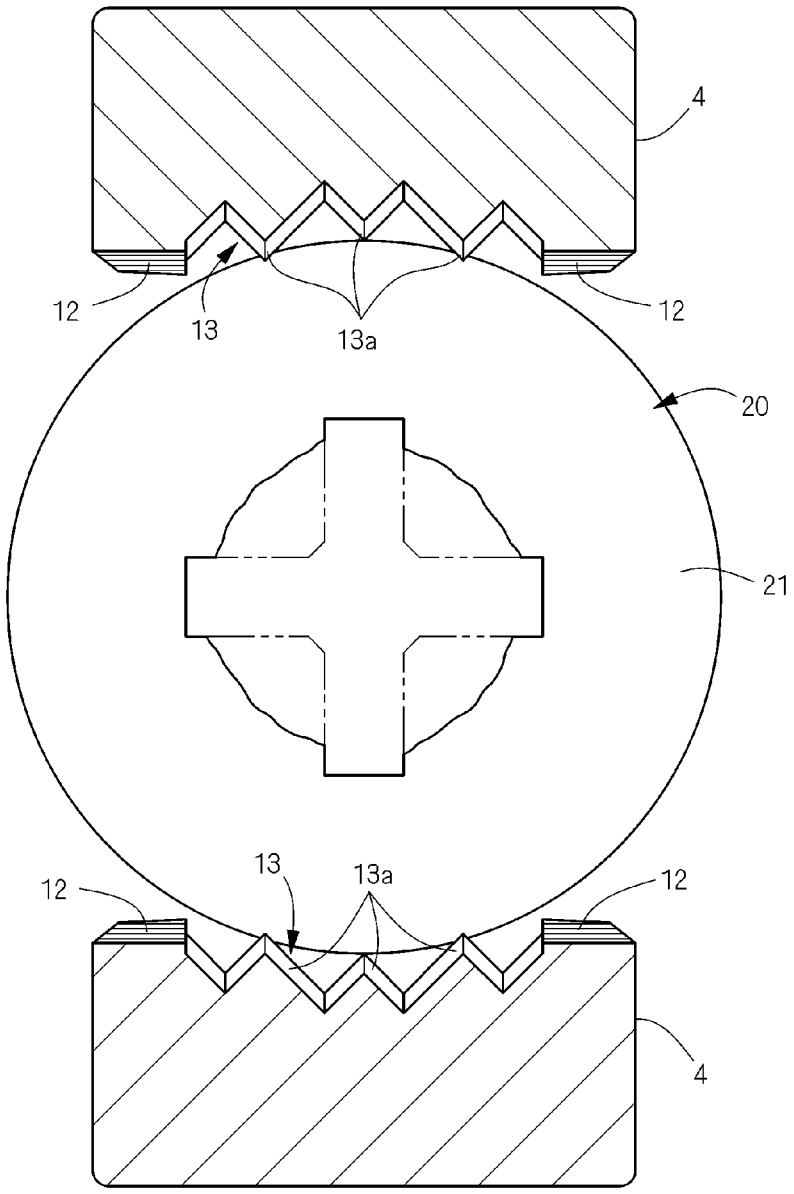
FIG. 7 is a sectional view taken along line B-B in FIG. 1.

If the flanks 16, 16 are formed on the left and right opposite sides of the front end faces of the jaw portions 4 as described above, when the pair of jaw portions 4, 4 pinch the peripheral face of the screw head 21 with as shown in FIG. 1, the longitudinal pinching teeth 13 can reliably pinch the peripheral face of the screw head 21 with front ends 17 of the streak teeth 13*a* thereof in contact with the screw fastened face 22. Therefore, even in the case of the screw 20 having the small thickness T of the peripheral face, the longitudinal pinching teeth 13 (?) can press the streak teeth 13*a* against or cause them to bite into the peripheral face of the screw head 21 as shown in FIGS. 6 and 7 to turn the screw 20 in a loosening direction. Although the embodiment shows the example that the screw 20 is a small truss screw, even if the screw 20 is a small round screw, the longitudinal pinching teeth 13 can similarly press the streak teeth 13*a* against or cause them to bite into the peripheral face of the screw head 21 in contact with the screw fastened face 22 to turn the screw 20 in the loosening direction.

Figure 12:
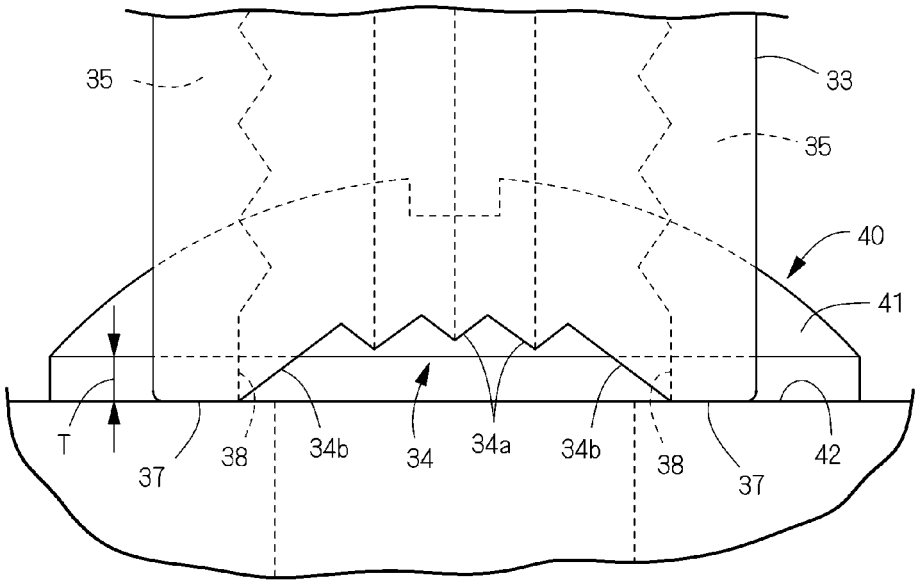
FIG. 12 is an explanatory view of a state of use of the prior-art pair of pliers.

Because the flanks 16, 16 are formed by the slopes on the left and right opposite sides of the front ends of the jaw portions 4 in the embodiment, the flanks 16, 16 can prevent themselves from coming in contact with the screw fastened face 22, even if the jaw portions 4 are inclined with respect to the screw fastened face 22 when the longitudinal pinching teeth 13 pinch the peripheral face of the screw head 21. Therefore, even if the screw 20 to be removed is in a narrow space, the longitudinal pinching teeth 13 can firmly hold the peripheral face of the screw head 21 to remove the screw. Moreover, it is possible to save trouble and cost required for working of the flanks 16. For example, it is possible to easily form the flanks 16, 16 by shaping the above-described slopes simultaneously with finish shaping of peripheral faces of the jaw portions 4 by grinding, for example. Incidentally, in the prior-art pair of pliers shown in FIG. 12, the front ends 37 of the front pinching teeth 35 and the front ends of the streak teeth 34*a* of the longitudinal pinching teeth 34 are far away from each other and therefore it is necessary to shave off larger parts to form appropriate flanks. The larger the parts to be shaved off, the greater the fear that the functions of the front pinching teeth 35 are impaired becomes.

Figure 8A:
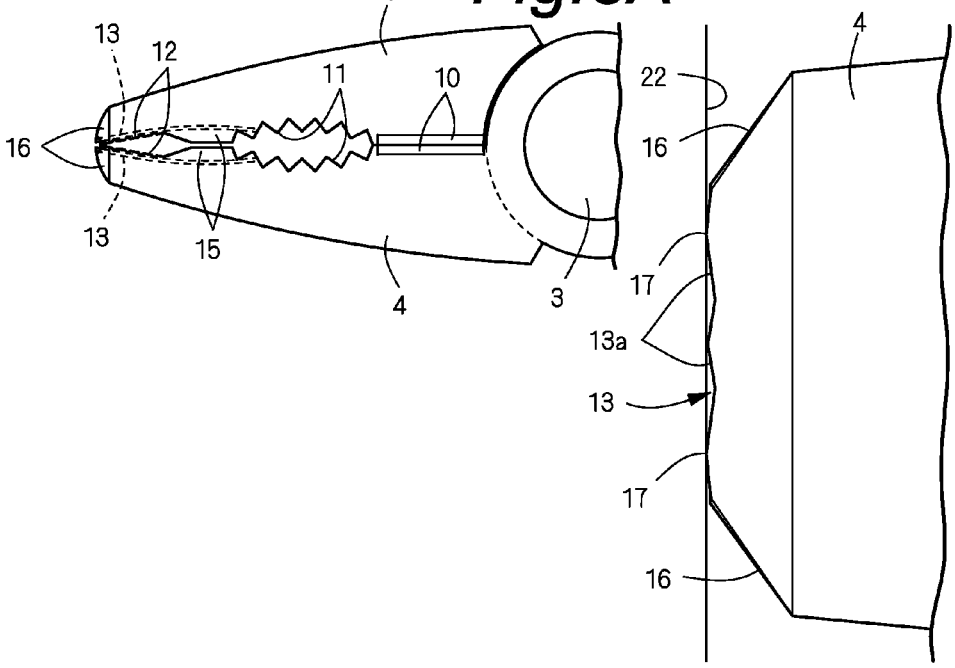
FIGS. 8(*a*) and 8(*b*) are side view and an explanatory view of a state of use respectively showing a closed state and an open state of the pair of pliers.
Figure 8B:
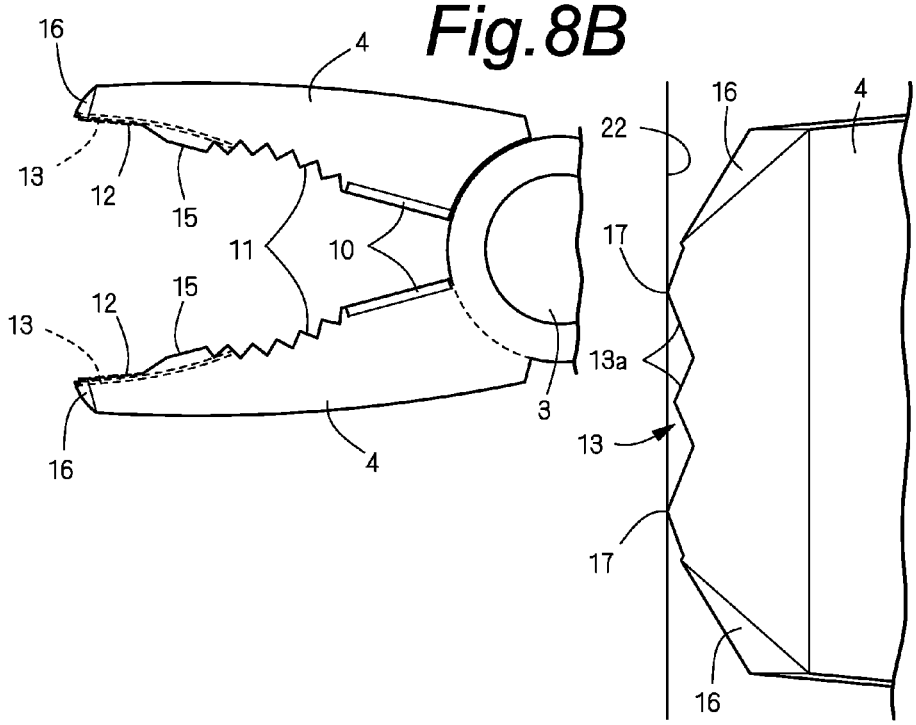

FIG. 8(*a*) shows a state in which both the jaw portions 4, 4 are closed and FIG. 8(*b*) shows a state in which both the jaw portions 4, 4 are opened to fully opened positions. In the closed state of both the jaw portions 4, 4, the front ends 17 of the three streak teeth 13*a* forming the longitudinal pinching teeth 13 are substantially flush with each other, so as to be in contact with the screw fastened face 22. In the fully-opened state of both the jaw portions 4, 4, the imaginary lines connecting protruding ends of the respective streak teeth 13*a* are in the curved shapes recessed upward or downward, so that the longitudinal pinching teeth 13, 13 can pinch the peripheral face of the screw head 21 with only the front ends 17 of the left and right opposite streak teeth 13*a* in contact with the screw fastened face 22.

As described above, an attitude of the upper and lower longitudinal pinching teeth 13, 13 change from a tapered shape to a flared shape depending on a degree of opening of the jaw portions 4, 4. The wider the opposed attitudes of both the longitudinal pinching teeth 13, 13, the harder it becomes to pinch the screw head 21. In the embodiment, however, the side shapes of the streak teeth 13*a* on the upper jaw portion 4 are the curved shapes recessed upward and the side shapes of the streak teeth 13*a* on the lower jaw portion 4 are the curved shapes recessed downward, which delays flaring of the upper and lower longitudinal pinching teeth 13, 13 and presses the streak teeth 13*a* against or allows them to bite into the peripheral face of the screw head 21. Therefore, the longitudinal pinching teeth 13, 13 can properly pinch screws 20 of different nominal dimensions in a wide range of sizes. If the nominal dimension of the screw 20 is small, the longitudinal pinching teeth 13, 13 can pinch the peripheral face on the fastened face side of the screw head 21 is pinched with the front ends 17 of the streak teeth 13*a*.

Figure 9:
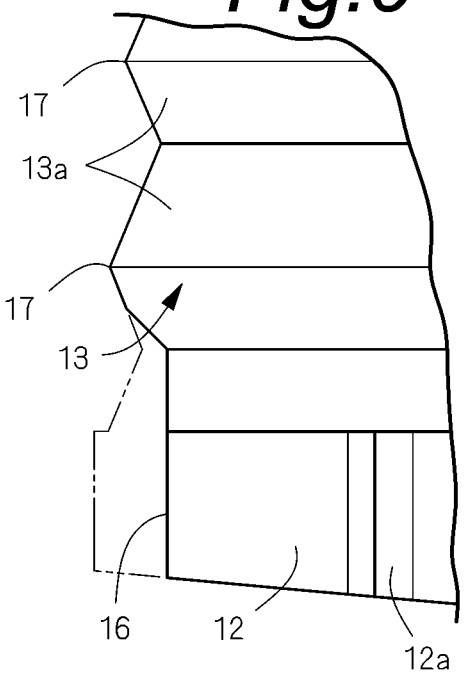
FIG. 9 is a partial plan view showing another embodiment of a flank.

FIG. 9 shows another embodiment of the flanks 16. In this embodiment, the flanks 16 are formed as vertical flat faces orthogonal to lines of peaks and troughs of the streak teeth 13*a* of the longitudinal pinching teeth 13 at front ends of the left and right front pinching teeth 12, 12. Each of the flanks 16 in this case can be formed by removing the front end of the front pinching tooth 12 shown by an imaginary line by grinding. Alternatively, the flanks 16 can be formed by forming the above-described flat faces in casting both the first and second arms 1 and 2 and finishing surfaces of the flat faces by grinding. Because the flat faces (flanks 16) in the embodiment are located behind the front ends 17 of the streak teeth 13*a*, the front ends 17 of the streak teeth 13*a* can initially collide with the screw fastened face 22 similarly to the previous embodiment.

Figure 10A:
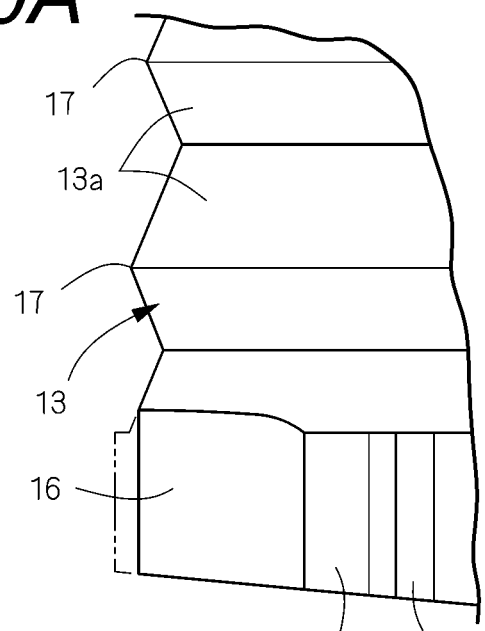
FIGS. 10(*a*) and 10(*b*) are a partial plan view and a side view showing still another embodiment of the flank.
Figure 10B:
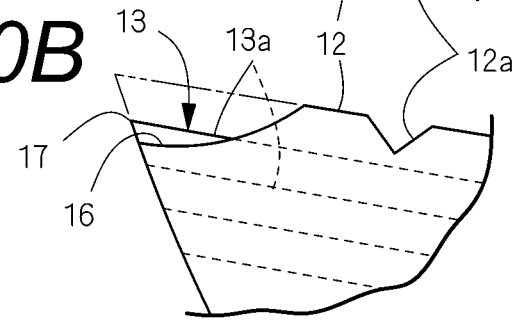

FIG. 10 shows still another embodiment of the flank 16. In this embodiment, each of the flank 16 is made up of a notch face formed by recessing each of opposed faces (shown by an imaginary line) of the front ends of the left and right front pinching teeth 12, 12. Specifically, the flanks 16 are formed in shapes of arc faces by cutting the opposed faces of the front ends. It is essential only that front end edges of the flanks 16 in this case be located behind the front ends 17 of the streak teeth 13*a* and the shapes of the cut faces do not necessarily have to be arc faces. If depth of the arc face shown in FIG. 10(*b*) is increased, it is possible to locate the front end edges of the flanks 16 further away behind the front ends 17 of the streak teeth 13*a*. As can be understood from the above description, the flanks 16 according to the invention may be formed on any of or a plurality of faces of side faces, front faces, opposed faces of the jaw portions 4 as far as they are formed on the left and right opposite sides of the front ends of the jaw portions 4.

Although each of the longitudinal pinching teeth 13 is made up of the three streak teeth 13*a* in the embodiment described above, this is not essential and the longitudinal pinching tooth 13 can be made up of at least two streak teeth 13*a*. If the longitudinal pinching tooth 13 is not made up of the rib-shaped streak teeth 13*a* connected in the front-back direction, it may be formed in disconnected rib shapes by dividing the streak teeth 13*a* with narrow grooves orthogonal to the lines of the peaks and troughs. If necessary, the longitudinal pinching tooth 13 may be made up of a group of diamond-patterned recessed and protruding bodies provided on a recessed face. The opening spring 7 may be omitted. The invention can be applied to a pair of combination pliers as well without problems.

The cutting blades 10, the back pinching teeth 11, or the front pinching teeth 12 may be omitted. For example, the front pinching teeth 12 may be omitted and the longitudinal pinching teeth 13 may be formed throughout the left-right width of the opposed faces of the front ends of the jaw portions 4. In this case, small chamfered flanks 16 are preferably formed at front ends of the left and right side faces of the jaw portions 4. Although the side shapes of the longitudinal pinching teeth 13 and the streak teeth 13*a* on the upper and lower jaw portions 4 are preferably in the curved shapes recessed upward or recessed downward, they may be in bent shapes recessed upward or recessed downward, if necessary. Furthermore, the side shapes of the longitudinal pinching teeth 13 and the streak teeth 13*a* may be formed in a lying-down V shape tapered toward the front ends of the jaw portions. The front end faces of the jaw portions 4 in a side view need not be rounded in partial arc shapes but may be made up of flat faces. If the front end faces of the jaw portions 4 are made up of the flat faces, the flat faces may be orthogonal to a front-back central axis of the pliers or the flat faces may diagonally intersect with the front-back central axis of the pliers in the closed state of both the jaw portions 4, 4.

EXPLANATION OF SYMBOLS

1 First arm
2 Second arm
3 Coupling shaft
4 Jaw portion
11 Back pinching tooth
12 Second horizontal pinching tooth
13 Vertical pinching tooth
13*a* Streak tooth
16 Flank
17 Front end of streak tooth
21 Screw head
22 Screw fastened face

The invention claimed is:

1. A pair of pliers comprising:

a first arm and a second arm each having a jaw portion at a front end and a grip on a back end side, wherein said first and second arms are coupled through a coupling shaft in an X shape, flanks for preventing opposite corners of front ends of each of the jaw portions from coming in contact with a screw fastened face, wherein said flanks are formed on left and right sides of the front end of each of the jaw portions, longitudinal pinching teeth capable of pinching a peripheral face of a screw head while being orthogonal to the screw fastened face, wherein said pinching teeth are formed to be recessed in opposed faces of the respective jaw portions between the left and right flanks, and, wherein each of the longitudinal pinching teeth is formed by connecting, in shapes of peaks and troughs in a left-right direction, a plurality of streak teeth extending in a front-back direction, and, wherein the front ends of the flanks are located behind front ends of the streak teeth.

2. The pair of pliers according to claim 1, wherein:

the longitudinal pinching teeth are formed on each of the opposed faces of front portions of the respective jaw portions, and the flanks of the respective jaw portions are provided to front portions of the opposite front pinching teeth.

3. The pair of pliers according to claim 2, wherein the flanks comprise slopes inclined in shapes tapered toward the front ends of the jaw portions.

4. The pair of pliers according to claim 3, wherein side shapes of the streak teeth on the upper jaw portion are curved shapes recessed upward and side shapes of the streak teeth on the lower jaw portion are curved shapes recessed downward.

5. The pair of pliers according to claim 2, wherein:

the flanks comprise vertical flat faces formed at front ends of the left and right pairs of front pinching teeth, and front ends of the flanks are located behind the front ends of the streak teeth.

6. The pair of pliers according to claim 5, wherein side shapes of the streak teeth on the upper jaw portion are curved shapes recessed upward and side shapes of the streak teeth on the lower jaw portion are curved shapes recessed downward.

7. The pair of pliers according to claim 2, wherein:

the flanks comprise recessed notch faces formed in front ends of opposed faces of the pairs of left and right front pinching teeth, and front ends of the flanks are located behind the front ends of the streak teeth.

8. The pair of pliers according to claim 7, wherein side shapes of the streak teeth on the upper jaw portion are curved shapes recessed upward and side shapes of the streak teeth on the lower jaw portion are curved shapes recessed downward.

9. The pair of pliers according to claim 2, wherein side shapes of the streak teeth on the upper jaw portion are curved shapes recessed upward and side shapes of the streak teeth on the lower jaw portion are curved shapes recessed downward.

* * * * *